US005468215A

United States Patent [19]

Park

[11] Patent Number: 5,468,215

[45] Date of Patent: Nov. 21, 1995

[54] EXERCISE UNIT FOR WHOLE BODY

[75] Inventor: Chan-Min Park, Pusan, Rep. of Korea

[73] Assignee: Mi-Ran Ahn, Pusan, Rep. of Korea

[21] Appl. No.: 280,308

[22] Filed: Jul. 26, 1994

[51] Int. Cl.[6] ..... A61H 1/00

[52] U.S. Cl. ..... 601/23; 601/27; 601/85; 601/93

[58] Field of Search ..... 601/22, 27, 29–32, 601/85–87, 89, 90, 92, 93, 97, 98, 101, 103, 104; 482/79, 80, 146, 147, 907

[56] References Cited

U.S. PATENT DOCUMENTS

| | | | |
|---|---|---|---|
| 2,990,720 | 7/1961 | Scholtes | 601/85 |
| 4,711,229 | 12/1987 | Hengl | 601/93 |
| 5,107,822 | 4/1992 | Ohashi | 601/93 |
| 5,328,443 | 7/1994 | Lee | 601/92 |

FOREIGN PATENT DOCUMENTS

| | | | |
|---|---|---|---|
| 1292358 | 3/1962 | France | 601/27 |

*Primary Examiner*—Richard J. Apley
*Assistant Examiner*—Jeanne M. Clark
*Attorney, Agent, or Firm*—Michael N. Meller

[57] ABSTRACT

An exercise unit for applying a rectilinear vibration and a swing vibration to the user. The exercise unit is divided into a lateral vibration part and a swing vibration part which are driven by two separated driving motor respectively. The lateral vibration part converts a rotative motion of the motor into a rectilinear vibrating motion to provide the user with the rectilinear vibration. The swing vibration part converts the rotative motion into a swing vibrating motion to provide the user with the swing vibration. The two parts may be selectively driven by a single driving motor.

8 Claims, 10 Drawing Sheets

FIG.12 ( A )
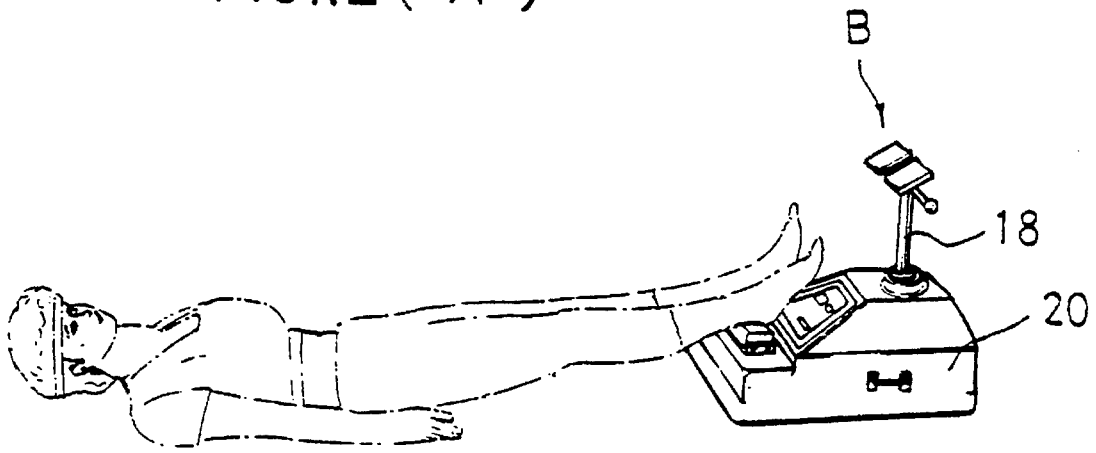
FIG.12 ( B )
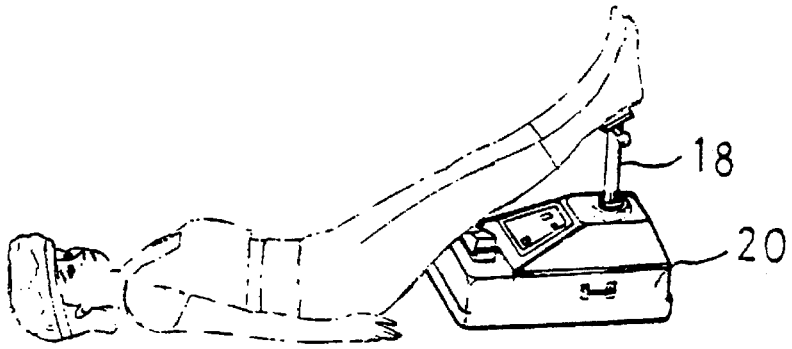

FIG. 12 ( C )
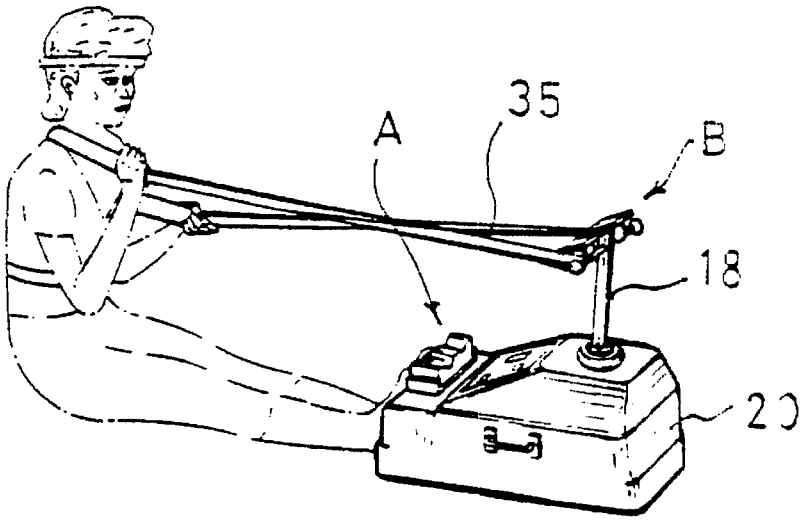
FIG. 12 ( D )
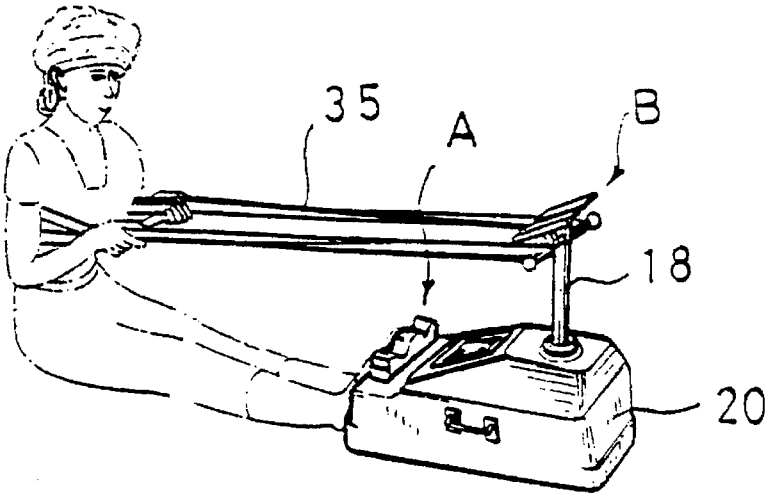

FIG.12( E )
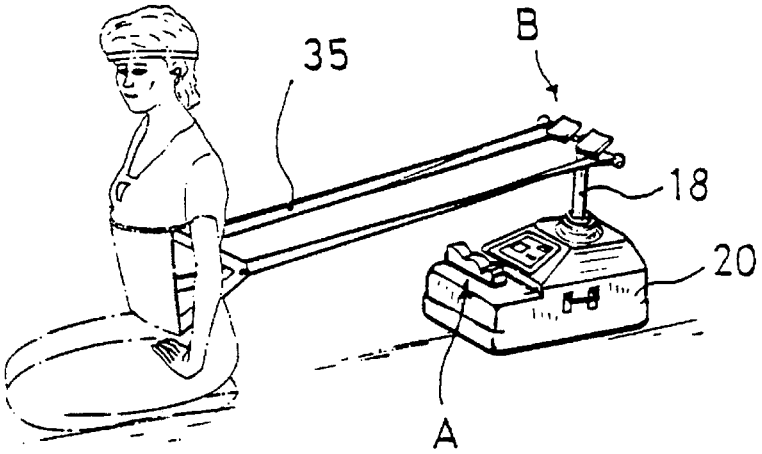
FIG.12( F )
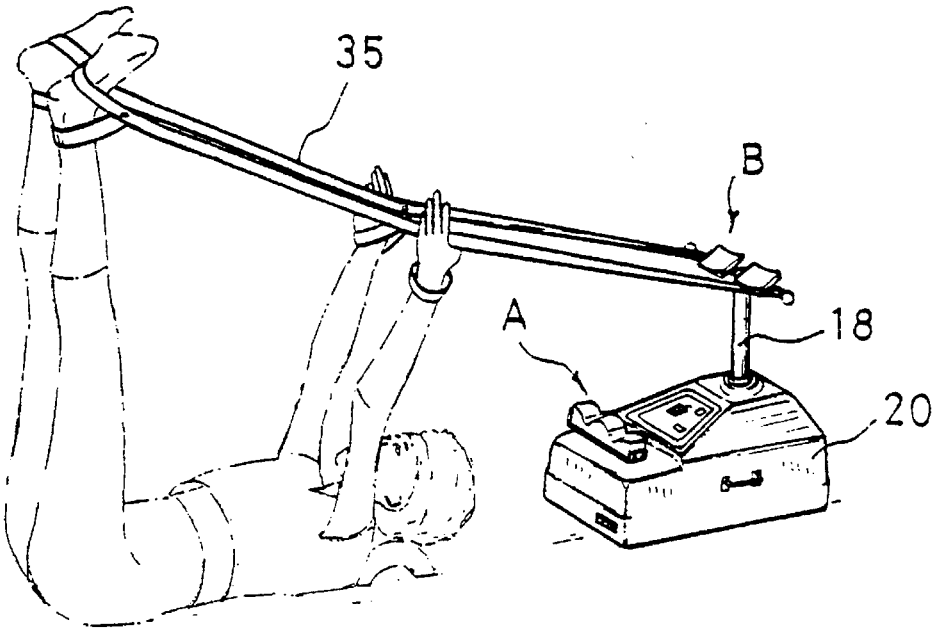

EXERCISE UNIT FOR WHOLE BODY

BACKGROUND OF THE INVENTION

1. Field of the Invention

The present invention relates to an exercise unit for whole body, and more particularly to an exercise unit for whole body which has a certain athletic effect upon the waist and the backbone as well as the arm and the leg to build up a healthy body by applying light lateral vibration and swing vibration to various parts of the body.

2. Description of the Prior Art

In exercise units which has been devised and used to promote health, most of the exercise units are designed to repeat certain exercises which are previously suited to characteristics thereof such that the exercise units cause various muscles of the body to be used to obtain certain exercise effects and thus to promote health.

Although various exercise units for whole body, except the above type of exercise units are also devised and used, the units are inconvenient to use because of the complicated structures and are impractical because of the high manufacturing cost. Furthermore, since the exercise units are complicated to use, exercise by means of the units can not be carried out continuously.

SUMMARY OF THE INVENTION

The present invention has been made in view of the above-described problems occurring in the various prior exercise units and an object of the invention is to provide an exercise unit which is convenient to use by virtue of its simple structure, can promote certainly health of the user, and can exert exercise effect upon the internal organs to prevent or treat disease.

In accordance with the present invention, the object mentioned above can be accomplished by providing an exercise unit for whole body comprising: a lateral vibration part having: a first driving motor; a plurality of reduction pulleys rotatably supported by bearing housings and connected to a shaft of the first driving motor via a belt, the reduction pulleys being connected to each other in power transmission; means for converting the rotating motion of the reduction pulley into a rectilinear reciprocating motion; and a foot rest member mounted on the converting means via a bracket; and a swing vibration part having: a second driving motor; a reduction pulley rotatably supported by a bearing housing and connected to a shaft of the second driving motor via a belt; an eccentric shaft fixed to a shaft of the pulley; a bearing member surrounding the eccentric shaft; a second connecting rod connected at an end to a side of the bearing member; a rotating shaft rotatably supported by a supporting member; a pivot member mounted on an outer periphery of the rotating shaft and connected to the other end of the second connecting rod; and a foot rest assembly mounted on the rotating shaft.

The lateral vibration part and the swing vibration part may be selectively driven by a single driving motor.

BRIEF DESCRIPTION OF THE DRAWINGS

These and other objects, features and advantages of the invention will become more apparent upon a reading of the following detailed specification and drawings, in which:

FIGS. 3A to 3C are sectional views showing operation of converting means of a lateral vibration part of the apparatus incorporating the principles of the invention;

FIG. 4A is an enlarged view of a portion of FIG. 4;

FIGS. 12A to 12F are a schematic views showing various usages of the exercise unit of the invention.

DETAILED DESCRIPTION OF THE PREFERRED EMBODIMENTS

Embodiments according to an exercise unit of the apparatus incorporating the principles of the present invention will be described in detail with reference to the accompanying drawings hereinafter.

Figure 1:
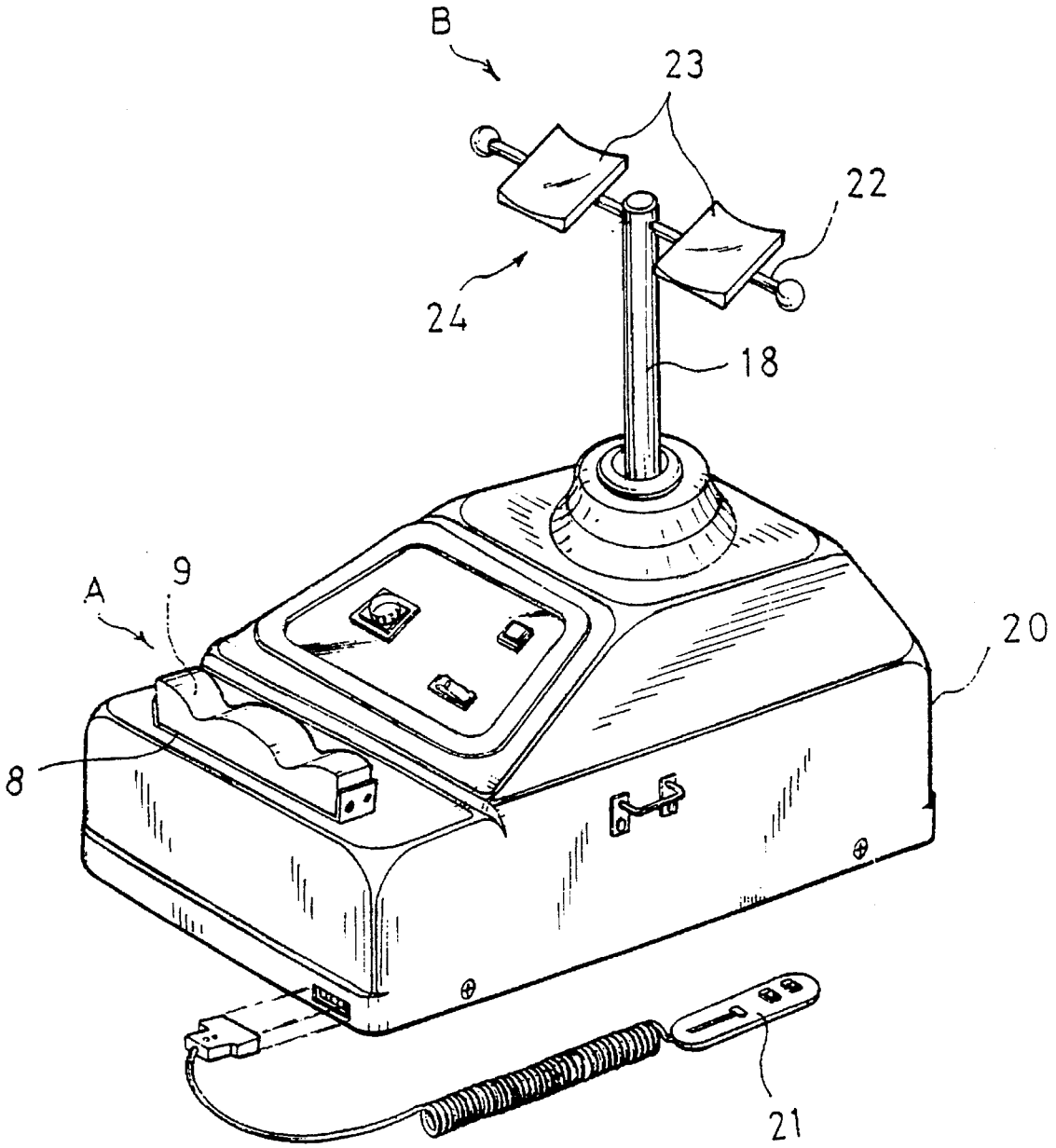
FIG. 1 is a perspective view of an exercise unit according to the present invention.
Figure 2:
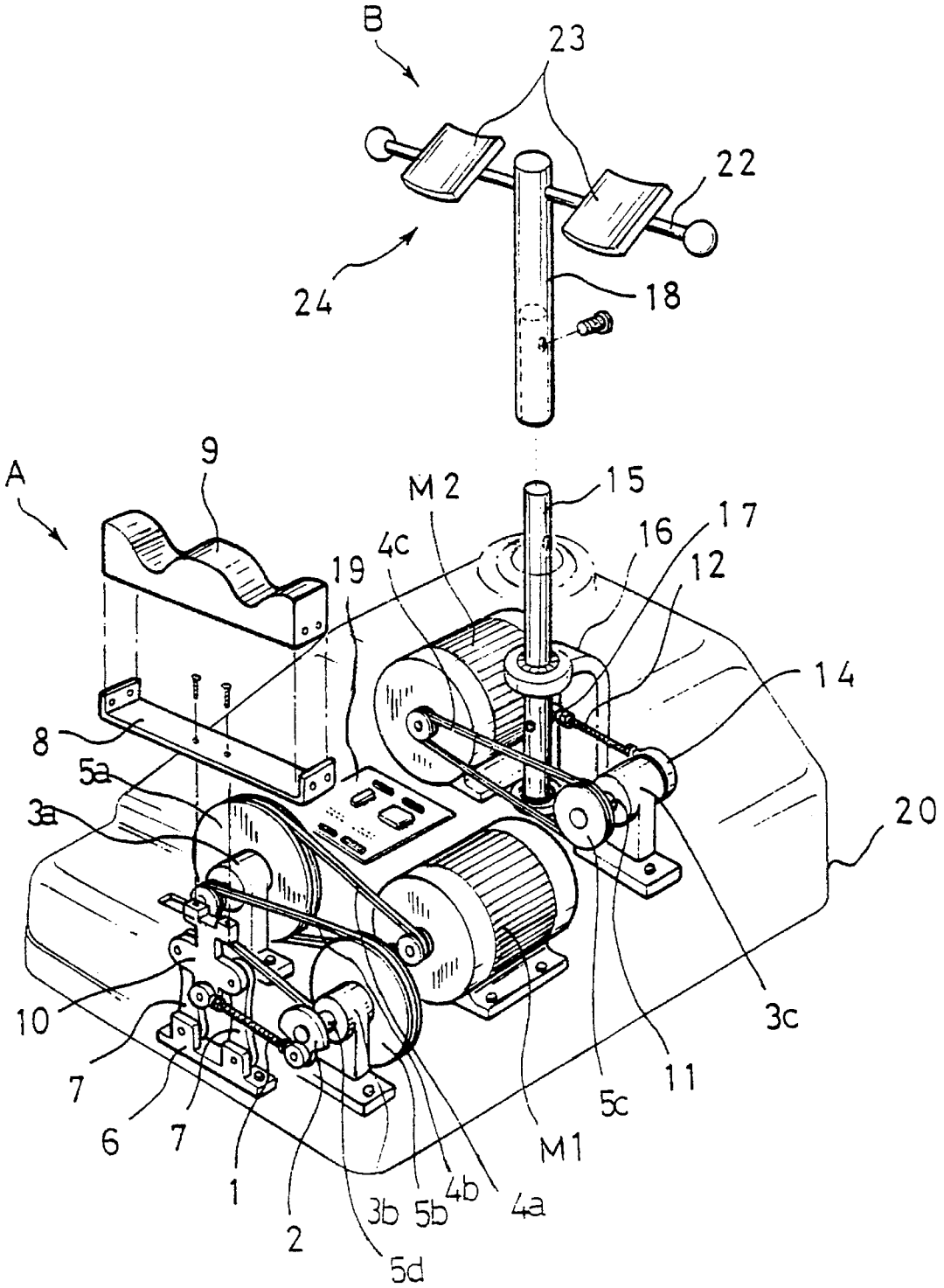
FIG. 2 is a perspective view of the exercise unit of FIG. 1 wherein a case is removed and several components are exploded.

FIG. 1 is a perspective view of an embodiment according to an exercise unit of the present invention which is completely assembled and FIG. 2 is a perspective view of the exercise unit of FIG. 1 in which a case is removed and several components are exploded for a better understanding of the drawing. As illustrated in the drawings, the exercise unit of the invention comprises a lateral vibration part "A" mounted on a base plate 33 (see FIGS. 3A to 3C) which is covered with a case 20 and a swing vibration part "B" wherein the lateral vibration part "A" and the swing vibration part "B" are constructed separately from each other.

Figure 3C:
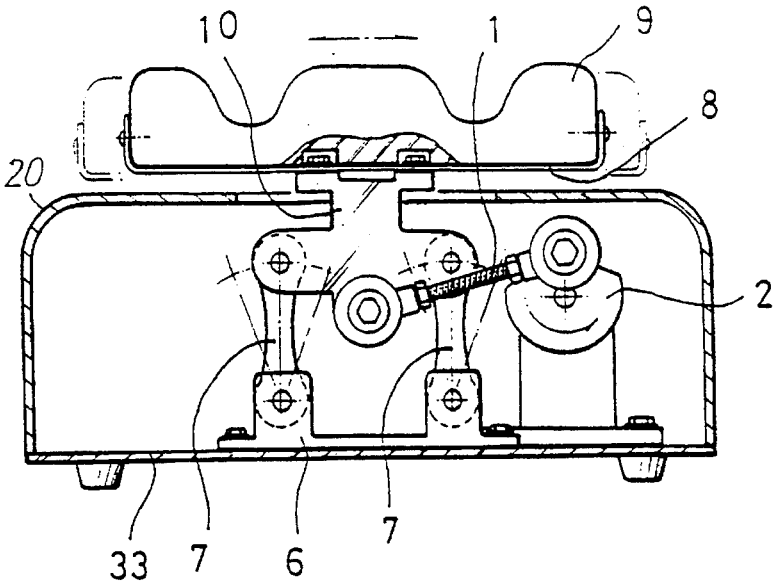
Figure 3C:
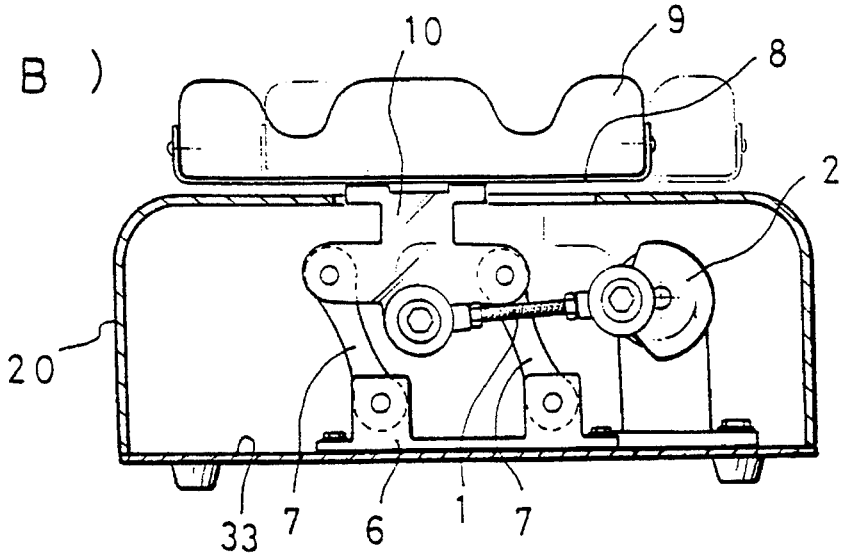
Figure 3C:
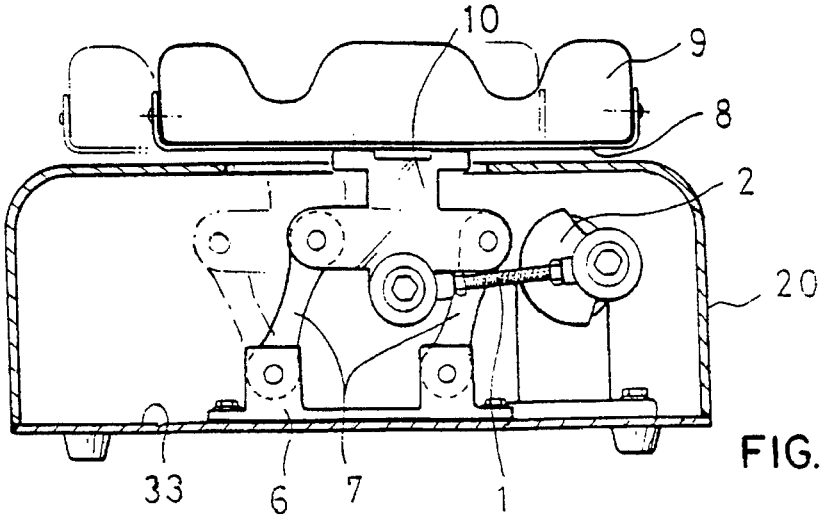

FIGS. 3A to 3C show operation of the lateral vibration part "A". As shown in FIGS. 1 to 3C, the lateral vibration part "A" comprises a first driving motor "M1", reduction pulleys 5*a* and 5*b* rotatably supported by bearing housings 3*a* and 3*b*, respectively and connected to the shaft of the first driving motor "M1" via a belt 4*b* wherein the reduction pulleys 5*a* and 5*b* are also connected to each other via a belt 4, a rotating piece 2 rotatably mounted on a shaft 5*d* of the last reduction pulley 5*b*, a connecting rod 1 connected to the rotating piece 2 at its end, a base member 6 mounted on the base plate 33, link members 7 pivotally supported on the base member 6 at their lower ends, a connect member 10 pivotally supported on the upper ends of the link members 7 and connected to the other end of the connecting rod 1 at its lower end, a gripping bracket 8 secured to the upper end of the connect member 10, and a foot rest member 9 mounted on the gripping bracket 8.

Figure 4:
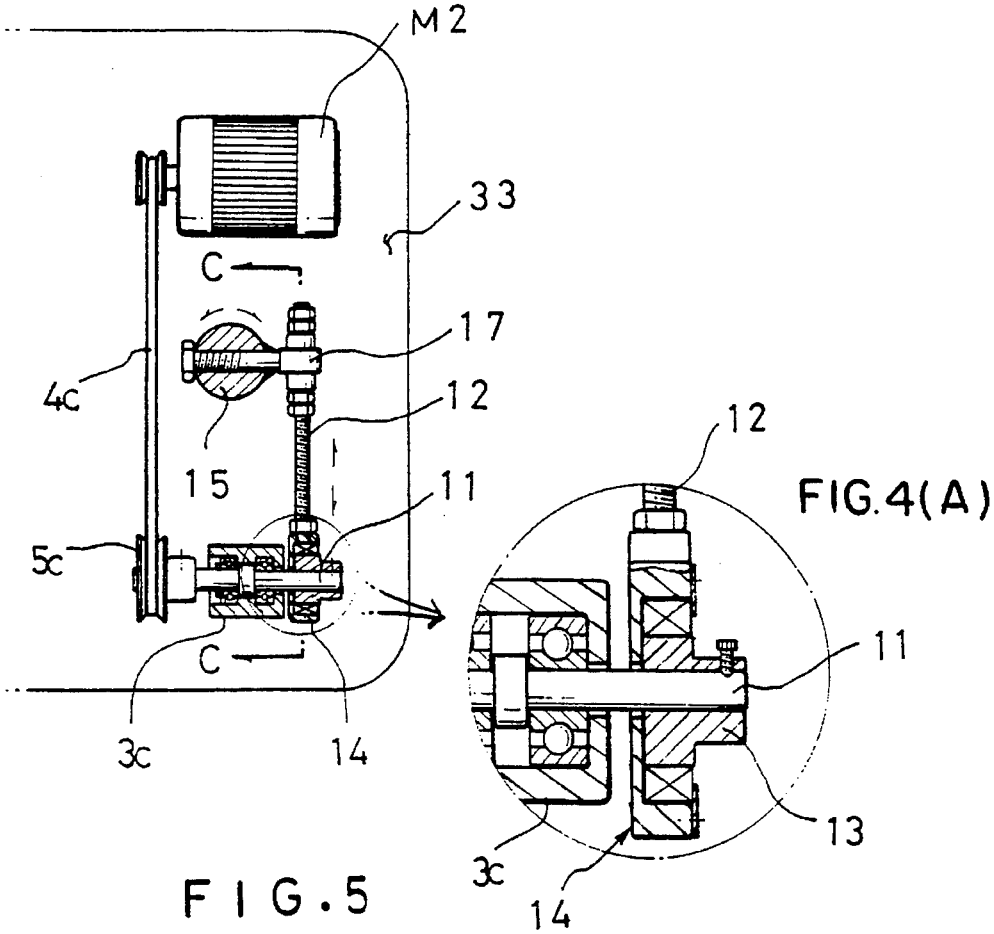
FIG. 4 is a plan view apparatus incorporating the principles of a swing vibration part of the invention.
Figure 5:
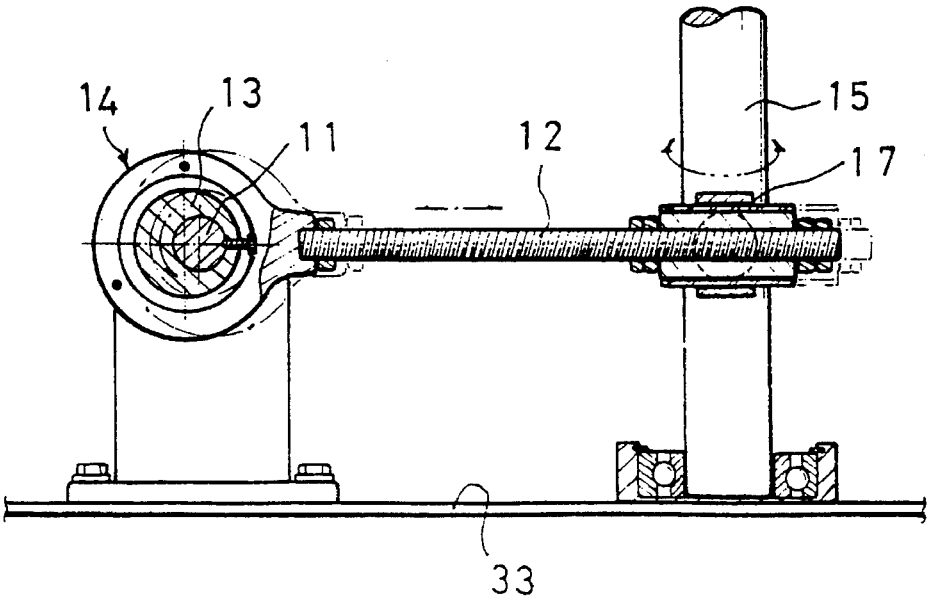
FIG. 5 is an enlarged sectional view taken along the line C—C of FIG. 4.
Figure 6:
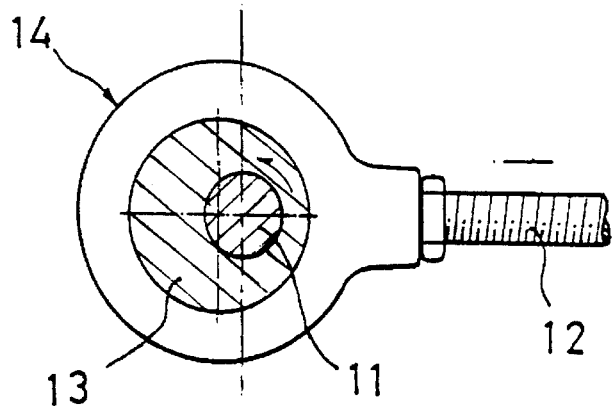
FIGS. 6A to 6D are sectional views showing operation of an eccentric shaft of the swing vibration part.
Figure 6:
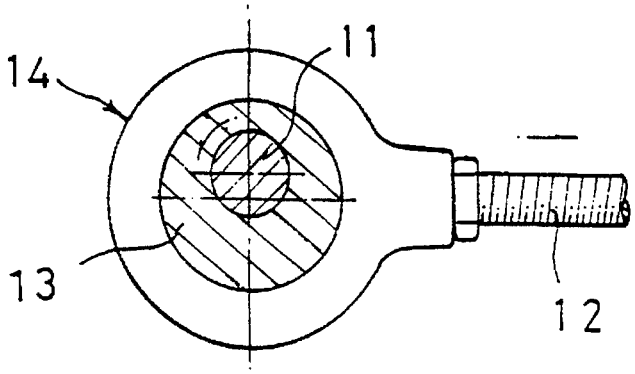
Figure 6:
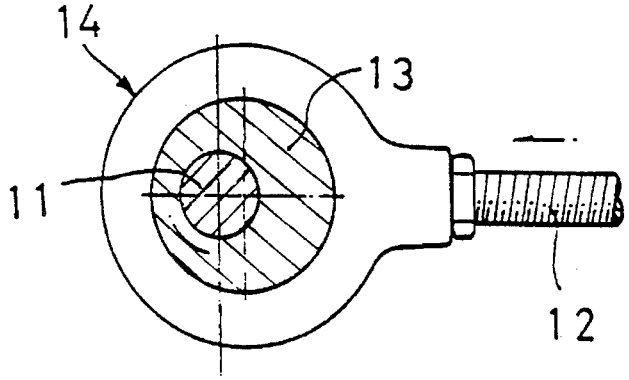
Figure 6:
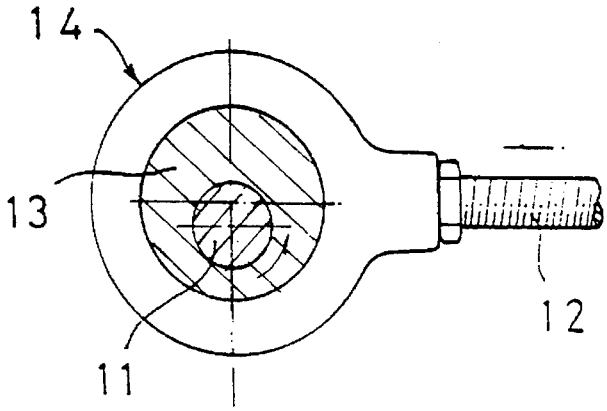

FIGS. 4 and 5 show essential components of the swing vibration part "B" and FIGS. 6A to 6D show operational principle of the swing vibrational part "B". As shown in FIG. 2 and FIGS. 4 to 6D, the swing vibration part "B" comprises a second driving motor "M2", a reduction pulley 5*c* rotatably supported by a bearing housing 3*c* and connected to a shaft of the second driving motor "M2" via a belt 4*c*, an eccentric shaft 13 fixed to a shaft) of the reduction pulley 5*c* (see enlarged view of FIG. 4*a*), a bearing member 14 inserted on the eccentric shaft 13, a connecting rod 12 fixed to an outer peripheral surface of the bearing member 14 at its end, a rotating shaft 15 rotatably supported by a supporting member 16 (see FIG. 2), a pivot member 17 mounted on an outer peripheral surface of the rotating shaft 15 and connected to the other end of the connecting rod 12, and a foot rest assembly 24 mounted on the rotating shaft 15.

The first and second driving motors "M1" and "M2" may be connected to a circuit board 19 connected to a control part (not shown) such that the rotational speeds of the driving motors "M1" and "M2" are and also selectively driven by manipulation of a switch on the case 20 or a remote control switch 21.

The foot rest assembly 24 of the swing vibration part "B" has a cylindrical shaft 18 inserted and secured to the rotating shaft 15, a supporting bar 22 secured to an upper end of the cylindrical shaft 18 and a pair of foot rest plates 23 mounted on the supporting bar 22.

In the structure of the exercise unit of the present invention, of rotating portions such as the bearing housings 3*a*, 3*b* and 3*c* and the supporting member 16 are provided with bearings so that the related components are smoothly operated and the life of the exercise unit is lengthened.

Operation of the above-mentioned exercise unit for whole body according to the invention will be now described hereinafter.

First, operation under the condition that the user's feet are put on the foot rest member 9 as illustrated in FIG. 12A is described. When the exercise unit is turned on by a direct manipulation of the remote control switch 21, the first driving motor "M1" is rotated in a predetermined rotative speed. The rotative speed of the first driving motor "M1" is reduced through the plurality of reduction pulleys 5*a* and 5*b* and the rotative force reduced in speed is transmitted to the rotating piece 2 via the shaft 5*d*.

Subsequently, as illustrated in FIGS. 3A to 3C, as the rotating piece 2 is rotated, the connecting rod 1 connected to the rotating piece 2 is reciprocated rightward and leftward. Hence, the connect member 10 is also reciprocated rightward and leftward under condition of being pivotally supported to the link members 7. Accordingly, the foot rest member 9 mounted on the connect member 10 shakes the user's feet put thereon rightward and leftward and thus shakes the user's whole body, thereby promoting relief of fatigue and circulation of blood. In this instance, since the user can control the rotative speed of the first driving motor "M1" and thus the reciprocating speed of the foot rest member 9 by manipulation of the switch, the exercise unit can efficiently build up healthy body.

Alternatively, the exercise unit of the invention may be also operated by utilizing the swing vibration part "B", as illustrated in FIG. 12B. In the operation by using the swing vibration part "B", the user's feet are put on the foot rest plates 23 and of the foot rest assembly 24 mounted on the rotating shaft 15. Upon turning on the exercise unit, the second driving motor "M2" is driven at a predetermined rotative speed. The rotative speed of the second driving motor "M2" is reduced into a lower predetermined speed through the reduction pulley 5*c* and then the rotative force of the driving motor is transmitted to the bearing member 14 via the eccentric shaft 13.

In this instance, since the rotating shaft 15 is rotatably fitted on the eccentric shaft 13 fixed to the shaft 11 of the reduction pulley 5*c* as illustrated in FIGS. 4, 5 and FIGS. 6A to 6D, the bearing member 14 is eccentrically rotated by the drive of the second driving motor "M2" and thus pushes and pulls the connecting rod 12 repeatedly.

As the connecting rod 12 is repeatedly reciprocated, the pivot member 17 connected to the other end of the connecting rod 12 and mounted on the rotating shaft 15 is also laterally reciprocated about an axis of the rotating shaft 15. As a result, the reciprocating motion of the connecting rod 12 causes the rotating shaft 15 to rotate clockwise and counterclockwise repeatedly. Therefore, the foot rest assembly 24 mounted on the rotating shaft 15 is rotated clockwise and counterclockwise repeatedly, so that the feet put on the foot rest assembly 24 are vibrated alternately, thereby building up a healthy body.

In this instance, since the rotative speed of the second driving motor "M2" can be also controlled by manipulation of the switch similarly to the lateral vibration part "A", the degree of the vibration applied to the feet can be controlled.

Although the exercise unit according to the present invention has been described so far with reference to an embodiment in which the rotating motion of the first driving motor "M1" is converted into rectilinear reciprocating motion of the foot rest member 9 via the link members 7 pivotally supported to the base member 6, the exercise unit according to the present invention may be embodied in another manner.

Figure 7:
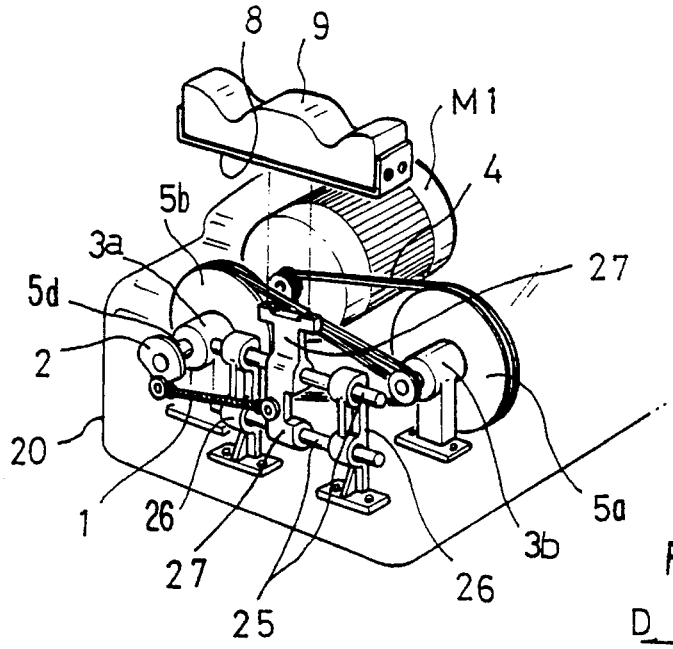
FIG. 7 is a perspective view of another embodiment of the converting means of the lateral vibration part of the apparatus incorporating the principles of the invention.
Figure 8:
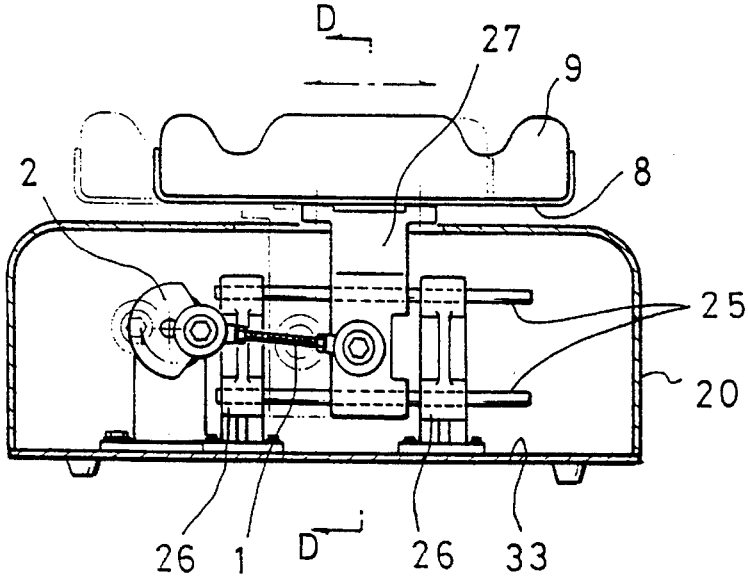
FIG. 8 is a sectional view showing operation of the converting means of FIG. 7.
Figure 9:
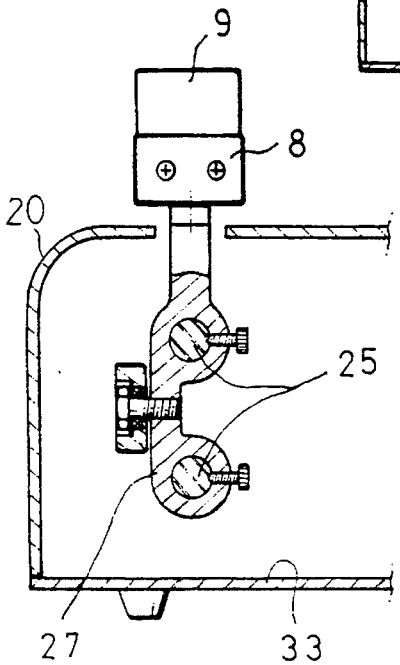
FIG. 9 is a sectional view taken along the line D—D of FIG. 8.

Referring to FIGS. 7 to 9, there are shown another means for converting rotating motion of the first driving motor "M1" into the reciprocating motion. As illustrated in the drawings, the connecting rod 1 is connected at an end to the rotating piece 2 rotated by the first driving motor "M1" and connected at the other end to a connect member 27. The connect member 27 is provided at its upper and lower portions with upper and lower sliding bars 25 fixed thereto. A pair of guide members 26 are secured to the base plate 33 with the connect member 27 interposed therebetween. Each of the guide members 26 is formed with upper and lower holes for guiding lateral motion of the sliding bars 25. Accordingly, the rotating motion of the first driving motor "M1" is converted into rectilinear reciprocating motion in such a manner that the rotative force of the motor is reduced in speed by the reduction pulleys 5*a* and 5*b*, transmitted to the rotating piece 1 and the connecting rod 2, and causes the connect member 27 guided by the guide members 26 to be reciprocated rectilinearly, thereby causing the foot rest member 9 to be shaken rightward and leftward.

Figure 10:
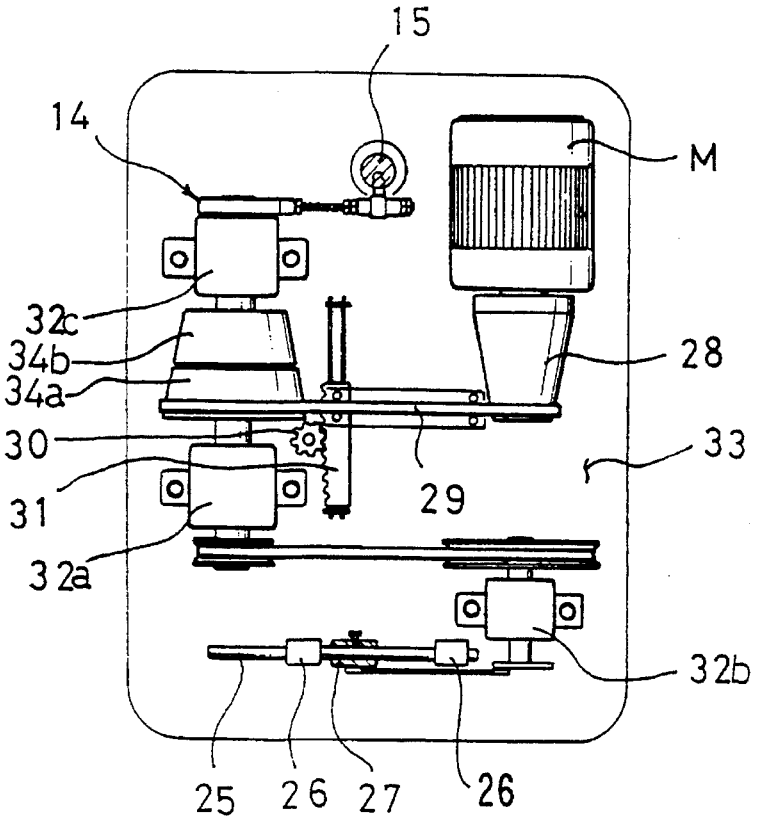
FIG. 10 is a plan view of another embodiment of the exercise unit according to the invention.
Figure 11:
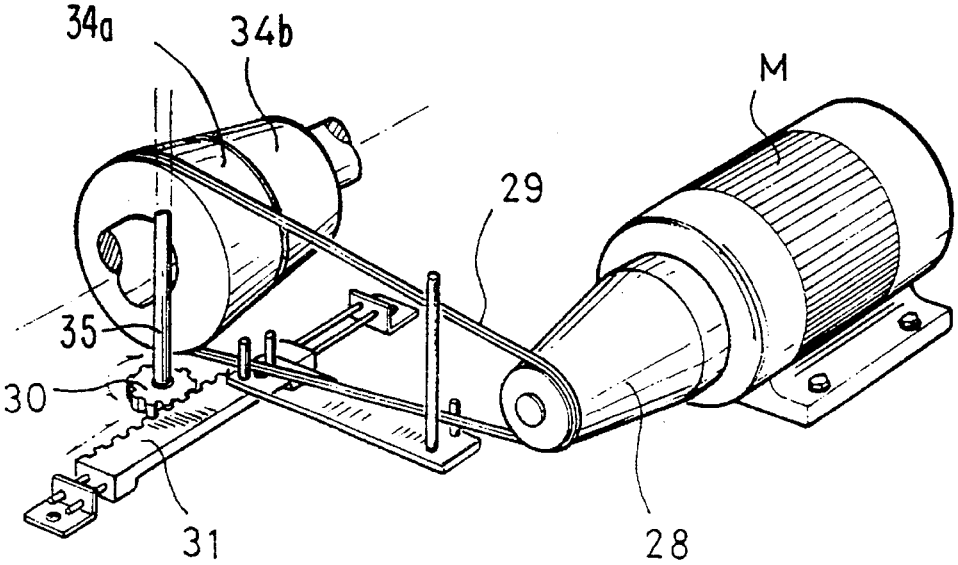
FIG. 11 is a perspective view showing operation of shifting means of FIG. 10.

Referring to FIGS. 10 and 11, there are shown another driving mechanism of the exercise unit of the invention which is adapted to drive the lateral vibration part "A" and the swing vibration part "B". In other words, only one driving motor "M" is utilized to drive the foot rest member 9 and the foot rest assembly 24, so that the one driving motor "M" can cause the foot rest member 9 to be shaken rightward and leftward and the foot rest assembly 24 to be partially rotated clockwise and counterclockwise.

If described in detail, a tapered pulley 28 is fixed to a shaft of the driving motor "M". A belt 29 is wrapped at a side about the tapered pulleys 28. A pair of tapered pulley 34*a* and 34*b* are rotatably supported by bearing housings 32*a* and 32*c*, respectively. Since the first larger tapered pulley 34*a* and the second smaller tapered pulley 34*b* are constructed as if they result from two cut portions generated by cutting a tapered body into two, the smaller tapered pulley 34*b* is separated from the larger tapered pulley 34*a* in power transmission and has an outer surface coinciding with an imaginary surface extended from the outer surface of the larger tapered pulley 34*a*. While the shaft of the larger tapered pulley 34*a* is connected to the rotating piece 2, the shaft of the smaller pulley 34*b* is connected to the bearing member 14. The belt 29, which is wrapped at the side about the tapered pulley 28, is selectively wrapped at the other side about the larger or smaller tapered pulley 34*a* or 34*b*. For this purpose, a belt shifting mechanism is interposed between the driving tapered pulley 28 and the two tapered pulleys 34*a* and 34*b*. The belt shifting mechanism comprises a pinion 30 fixed to an adjusting shaft 35 for rotating pinion 30 and a rack 31 engaged with the pinion 30. The rack 31 is provided with a plurality of guide bars which are protruded upward to contact with side surfaces of the belt 29. Hence, upon rotating the pinion 30 by means of the adjusting shaft 35 in a predetermined direction, the rack 31 is moved in an axial direction of the pulley 28 and the pulleys 34*a* and 34*b*. As the rack 31 is moved in the axial direction, the guide bars fixed thereto pull the belt 29 toward the lager tapered pulley 34*a* or the smaller tapered pulley 34*b*. Therefore, the belt 29 connected to the tapered pulley 28 of the driving motor "M" is selectively connected to the larger pulley 34*a* or the smaller pulley 34*b* by rotation of the pinion shaft. Hence, the lateral vibration part "A" and the swing vibration part "B" are selectively driven by the one driving motor "M".

Operation of the above-described exercise unit according to the invention will be described as follows.

When the exercise unit is used under condition that the user puts his heel portions on the foot rest member 9 of the exercise unit of the invention, the feet and thus the legs are repeatedly shaken rightward and leftward by vibration of the foot rest member 9. Therefore, fatigue of his feet is relieved and flood circulation of the whole body is promoted.

When the unit is used under condition that the user puts his heel portions on the foot rest assembly 24, the delicate rotating vibration of the foot rest assembly 24 is propagated over the whole body through the feet. Therefore, blood circulation are promoted and his internal organs is affected by the vibration, thereby improving the digestive performance and thus building up healthy body.

Furthermore, when the exercise unit of the invention is used under condition that the user's legs are put on the foot rest member 9 and the user's feet are put on the foot rest assembly 24, the rectilinear vibration of the foot rest member 9 and the swing vibration of the foot rest assembly 24 are applied to whole legs, thereby causing the waist and the backbone to be exercised and corrected. Therefore, the vibration effect on the body is more strongly enhanced.

In addition to the above usage, the exercise unit of the present invention may be used in such a manner as shown in FIGS. 12C to 12E. In this instance, a vibration belt 35 is connected to the opposite ends of the supporting bar 22 on which the foot rest plates 23 are mounted. The vibration belt 35 is integrally formed with protrusions serving as finger-pressure treating means. In use of the vibration belt, the protrusions are applied to desired areas of the body to press the areas and are vibrated by the vibration of the supporting bar 22 of the foot rest assembly 24, thereby providing the areas with the finger-pressure treatment and massage effects.

The exercise unit of the invention with the vibration belt 35 may be also used in such a manner as shown in FIG. 12F. As shown in the drawing, the vibration belt 35 is provided with straps at predetermined positions. In usage of the exercise unit of the invention together with the vibration belt 35 having straps, the user inserts his hands and feet into the straps respectively under the condition that the user has lain down on the floor. In this state, the user's hands and feet are vibrated by the vibration of the belt 35, whereby the user's fatigue is relieved and flood circulation is promoted.

As apparent from the above description, since the exercise unit for whole body according to the present invention is simple in structure, the exercise unit can be manufactured at a lower cost. Also, since the exercise unit can selectively generate the rectilinear vibration and the swing vibration, the unit can provide the user with a high exercise effect.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An exercise unit for whole body comprising:

a lateral vibration part having:

a first driving motor;

a plurality of reduction pulleys, including a first and a last pulley rotatably supported by bearing housings and connected to a shaft of the first driving motor via a belt, the reduction pulleys being connected to each other in power transmission;

means for converting the rotative motion of the reduction pulley into a rectilinear reciprocating motion; and a foot rest member mounted on the converting means via a bracket; and a swing vibration part having:

a second driving motor;

a reduction pulley rotatably supported by a bearing housing and connected to a shaft of the second driving motor via a belt;

an eccentric shaft fixed to a shaft of the pulley;

a bearing member surrounding the eccentric shaft;

a second connecting rod connected at an end to a side of the bearing member;

a rotating shaft rotatably supported by a supporting member;

a pivot member mounted on an outer periphery of the rotating shaft and connected to the other end of the second connecting rod; and a foot rest assembly mounted on the rotating shaft.

2. An exercise unit according to claim 1, wherein the foot rest assembly comprises a cylindrical shaft mounted on the rotating shaft, a supporting bar horizontally fixed to an upper end of the rotating shaft, and a pair of foot rest plates fixed to the supporting bar.

3. An exercise unit according to claim 1, wherein said converting means comprises a rotating piece fixed to an output shaft of said last reduction pulley, a connecting rod rotatably connected to a side of the rotating piece at one end thereof, a link member pivotally mounted at a lower end thereof on a base member fixed to a base of the unit and protruding upwardly, and a connect member pivotally mounted on an upper end of the link member and connected to the other end of the connecting rod, the foot rest member being mounted on the connect member.

4. An exercise unit according to claim 1, wherein said unit has a base and said converting means comprises a rotating piece fixed to an output shaft of said last reduction pulley, a connecting rod rotatably connected to a side of the rotating piece at one end thereof, a guide member fixed to the base of the unit and having at least one guide hole formed therethrough, a connect member having a sliding bar inserted into the guide hole and connected to the other end of the connecting rod, the foot rest member being mounted on the connect member.

5. An exercise unit for whole body comprising:

a driving motor having a tapered pulley fixed to a shaft thereof;

a lateral vibration part having:

a larger tapered pulley rotatably supported by a bearing housing and connected to the tapered pulley of the driving motor by a belt;

means for reducing a rotative speed of the larger tapered pulley;

means for converting the rotative motion of an output shaft of the reducing means into a rectilinear reciprocating motion; and a foot rest member mounted on the converting means;

a swing vibration having:

a smaller tapered pulley adjacent to the larger tapered pulley and having an outer surface coinciding with an imaginary surface extended from the outer surface of the larger tapered pulley, the smaller tapered pulley being rotatably supported by a bearing housing and connected to the tapered pulley of the driving motor by a belt;

an eccentric shaft fixed to a shaft of the smaller tapered pulley;

a bearing member surrounding the eccentric shaft;

a second connecting rod connected at one end thereof to a side of the bearing member;

a rotating shaft rotatably supported by a supporting member;

a pivot member mounted on an outer periphery of the rotating shaft and connected to the other end of the second connecting rod; and a foot rest assembly mounted on the rotating shaft; and means for shifting a side of the belt between the larger tapered pulley and the smaller tapered pulley while maintaining the other side of the belt on the tapered pulley of the driving motor.

6. An exercise unit according to claim 5, wherein the converting means comprises a rotating piece fixed to said output shaft of said reducing means, a connecting rod rotatably connected to a side of the rotating piece at one end thereof, a link member pivotally mounted at a lower end thereof on a base member fixed to a base of the unit and protruding upwardly, and a connect member pivotally mounted on an upper end of the link member and connected to the other .end of the connecting rod, the foot rest member being mounted on the connect member.

7. An exercise unit according to claim 5, wherein said unit has a base and said converting means comprises a rotating piece fixed to said output shaft of said reducing means, a connecting rod rotatably connected to a side of the rotating piece at one end thereof, a guide member fixed to the base of the unit and having at least one guide hole formed therethrough, a connect member having a sliding bar inserted into the guide hole and connected to the other end of the connecting rod, the foot rest member being mounted on the connect member.

8. An exercise unit according to claim 5, wherein the shifting means comprises a pinion fixed to an adjusting shaft, a rack engaged with the pinion, and a plurality of guide bars fixed to the rack which are protruded upward to contact with side surfaces of the belt, whereby the belt is selectively connected to the larger pulley or the smaller pulley by rotation of the adjusting shaft.

* * * * *